United States Patent [19]

Miller

[11] 4,154,012

[45] May 15, 1979

[54] EXPENDABLE LAUNCHER FOR NON-LETHAL RING AIRFOIL PROJECTILE

[75] Inventor: Miles C. Miller, Joppatowne, Md.

[73] Assignee: The United States of America as represented by the Secretary of the Army, Washington, D.C.

[21] Appl. No.: 854,569

[22] Filed: Nov. 25, 1977

[51] Int. Cl.[2] ..... F41C 27/06

[52] U.S. Cl. ..... 42/1 F; 102/DIG. 10

[58] Field of Search ..... 42/1 F; 102/DIG. 10

[56] References Cited

U.S. PATENT DOCUMENTS

| | | | |
|---|---|---|---|
| 3,619,924 | 11/1971 | Paine | 42/1 F |
| 3,712,224 | 1/1973 | Hanzel | 42/1 F |
| 3,826,031 | 7/1974 | Gabriels | 42/1 F |
| 3,919,799 | 11/1975 | Austin, Jr. et al. | 42/1 F |
| 3,956,843 | 5/1976 | Litman | 42/1 F |
| 3,980,023 | 9/1976 | Misevich | 102/DIG. 10 |
| 3,981,093 | 9/1976 | Reed | 42/1 F |

*Primary Examiner*—Charles T. Jordan

*Attorney, Agent, or Firm*—Nathan Edelberg; Robert P. Gibson; Harold H. Card, Jr.

[57] ABSTRACT

A pre-loaded grenade launcher attachable to the muzzle of a gun is constructed of inexpensive plastic and contains a grenade. After quick attachment of the launcher to a gun, and launching of the grenade, the launching attachment is discarded and may be replaced by another pre-loaded launcher.

5 Claims, 2 Drawing Figures

EXPENDABLE LAUNCHER FOR NON-LETHAL RING AIRFOIL PROJECTILE

DEDICATORY CLAUSE

This invention can be used and made by the United States Government without the payment of royalties thereon.

BACKGROUND OF THE INVENTION

Modern riot control devices of non-lethal type include a variety of weapons and projectiles such as rubber bullets, cloth bags filled with shot, and water-filled plastic balls. These projectiles include special cartridges, special weapons and sabots of various shapes in which the projectile is nested during launch and which separate from the projectile after it leaves the muzzle of the launching device.

A characteristic problem of sabot-launched non-lethal projectiles is that the sabot which is fired from the launcher along with the projectile can cause more serious injury than the projectile. Thus, the sabot is a thrust transmitting carrier which imparts the total launching force to the projectile, hence, the sabot is typically of strong and rigid construction, and may be even stronger than the projectile itself. In such cases, when both leave the launcher muzzle, the sabot can be more hazardous to nearby personnel than the projectile.

Another problem is that the loading of the projectile and sabot into a launching device is often a rather delicate operation, since much care is required to insure uniform contact between the launcher barrel and the sabot so that asymmetrical forces will not adversely affect the expected trajectory of the projectile during launch. Under the emotional pressure of riot conditions, such delicacy of operative procedure to load individual grenades accurately and hastily requires a high degree of dexterity and considerable training. The time and expense involved in specialized training of this type is not available to many law-enforcement agencies. Moreover, reusable grenade launchers are generally of sturdy construction to resist the corrosion and wear associated with repeated use and frequent cleaning, all of which adds to their initial cost as well as maintenance costs.

As important recent development in riot control devices is the so-called ring airfoil grenade or RAG projectile disclosed in U.S. Pat. Nos. 3,982,489, 3,951,070, and 3,877,383. The RAG projectile provides a flat trajectory profile with low velocity decay resulting in a high degree of accuracy. The sting RAG is relatively rigid and impacts a human target with disabling but non-lethal force, while the soft RAG may be filled with disabling chemical agents and does not involve any significant impact force. The invention disclosed herein will be illustratively described in connection with the foregoing type of riot control projectiles.

BRIEF SUMMARY OF THE INVENTION

The invention essentially consists of a grenade launching attachment 10 adapted to be removably affixed to the muzzle of a gun barrel 12 shown in FIG. 1. The launcher has a plenum chamber 44 into which propellant gases from a fired cartridge in the gun exit through the muzzle. The pressure of these gases applies force to laterally translatable plate 42 which transmits such force to displace sabot 52 and grenade 54 nested therewithin forward along launcher barrel 64. After exiting from the barrel 64, the sabot 52 is broken into fragments and plate 42 is abruptly arrested and securely stopped by a conical wedge 60 at the distal end of center mandrel 56, which is cantilever mounted at its base close to plenum chamber 44. Upon launching, the projectile 54 separates from the broken sabot and continues its movement toward a target along a path determined by the direction and position of barrel 64, whereupon launcher 10 is removed, discarded, and replaced with another pre-loaded launcher.

DETAILED DESCRIPTION OF THE PREFERRED EMBODIMENT

Figure 1:
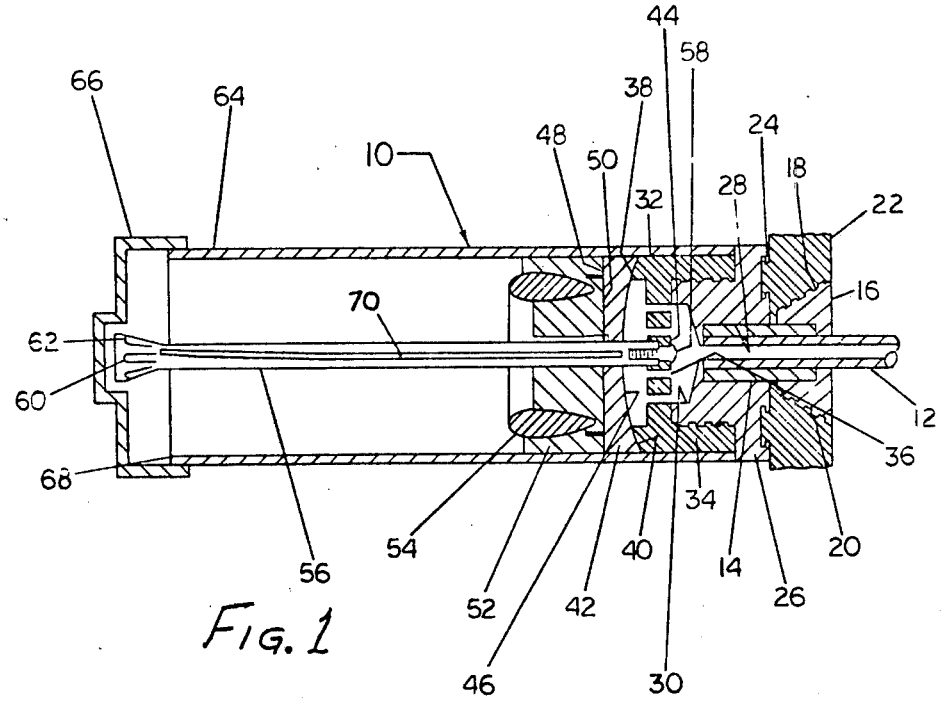
FIG. 1 is a side directional view in cross section of the inventive structure prior to the launching of a grenade.

Referring to FIG. 1, the invention may be seen to comprise a grenade launching system generally designated by reference numeral 10 adapted to be removably affixed to the muzzle end of a gun barrel 12. It will be understood by gunsmiths that gun muzzles have a wide variety of diverse configurations which depend on the size, type, and functional purpose of each gun, and that the invention in this case does not reside in the particular means used to attach launcher 10 to barrel 12, provided only that the launcher be securely attachable to the barrel and manually removable therefrom.

For the sake of illustration, the invention will be described in conneciton with its use on M—16 rifle barrels which have a flash suppressor 14 affixed thereto. To the flash suppressor 14 is affixed a conical projection 16 having a plurality of grooves 18 machined into its outer surface to form a helical thread 20 of rectangular cross-section as seen in FIG. 1. The purpose of the mentioned thread is to enable rapid and secure attachment of various devices to the gun such as by means of a ring lock 22 in this case. Ring 22 has locking means in the form of lugs 24 with annular flanges on each lug.

Launcher 10 illustratively includes muzzle attachment means in the form of bushing 26 containing a number of keyed slots corresponding to the number and location of lugs 24, whereby cooperative engagement of ring 22 and bushing 26 results in firm engagement of the lugs and slots to secure these two elements in firm stationary relationship with each other. Bushing 26 further includes inner bearing surface 28 sized and adapted to make close and continuous contact with the outer surface of flash suppressor 14. Bushing 26 has a cylindrical projecting portion 30 with a helical thread formed thereon and adapted to threadably engage an annular block 32 having a thread oppositely corresponding to the thread on bushing 26. Block 32 has a center wall portion 34 extending radially outward from the longitudinal center axis of said block which coincides with the center axis of barrel 12. Wall 34 has a plurality of ports or passages 36 therethrough. Block 32 has an annular bearing surface 38 adapted to make close seating contact with an oppositely corresponding contoured bearing surface 40 on a disk or plate 42 which acts as a force-transmitting means in a manner described below.

Figure 2:
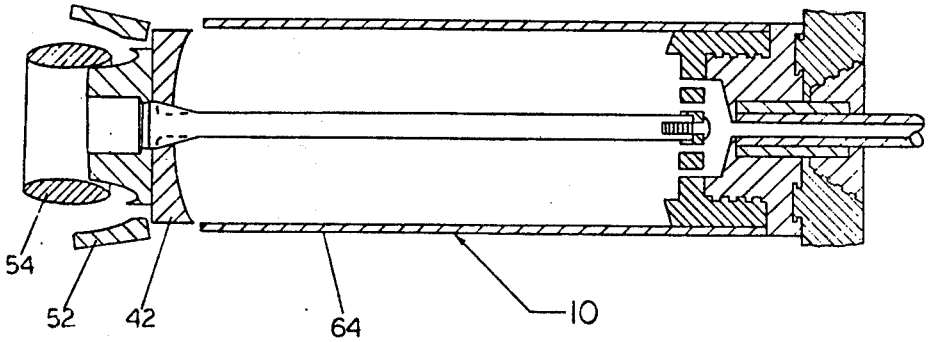
FIG. 2 is a view corresponding to FIG. 1. but with the grenade exiting the launcher.

The inner surfaces of bushing 26 and block 34 are configured so as to form a plenum chamber or enclosed pressure chamber 44 when these two elements are joined in the operative relationship seen from FIGS. 1 and 2. Depending upon fabrication methods and materials, these two elements might be integrally formed as a single unitary part and still function in the same manner as discussed above within the scope of this invention.

Plate 42 communicates with chamber 44 and has a shallow concave surface 46 and a substantially flat surface 48 abutting against a correspondingly flat surface 50 of sabot 52 as shown in FIG. 1. Sabot 52 is a thrust-transmitting carrier and has a ring airfoil grenade projectile 54 nestled in close supporting and force-transmitting relationship within sabot 52. The sabot has a center hollow passage axially therein concentric about an elongate rod or mandrel 56 which is axially aligned with the center bore of barrel 12. Rod 56 is secured at one end thereof to center wall portion 34 by suitable means such as attachment screw 58, while the opposite end of rod 56 has a radially projecting flange-like protuberance 60 which, in the perferred embodiment, has a generally conical shape and is fluted by means of parallel grooves 62. Rod 56 might conceivably be fabricated integrally with block 32 and bushing 26, within the scope of this invention. All of the foregoing elements of launcher 10 are contained and supported within elongate hollow tube 64 which acts as a guide during movement of sabot 52 when the launcher is activated. A protective cap 66 may be force-fit over the end of tube 64 and removed just prior to use of the launcher. Alternatively, cap 66 may be a relatively thin dust cover which is punctured or shattered by sabot 52 or grenade 54 when both exit from tube 64. This design option will depend upon the materials of construction of cap 66 and sabot 52 which may vary considerably without departing from the scope of this invention.

In operation, grenade launcher 10 is entirely assembled with sabot 52 and projectile 54 positioned therewithin. The launcher is issued to user personnel such as law enforcement officers at the time that tactical needs require its use. Being pre-loaded, the user need only attach the launcher to his gun, a relatively simple and quick operation, and the device is ready to operate. A blank cartridge is chambered in the gun, which is aimed at a target using conventional aiming techniques. When the cartridge is fired, propellant gases in barrel 12 escape through the muzzle into chamber 44 and through holes 36, applying pressure to plate 42 which makes close uniform surface contact with tube 64 about the peripheral edge of plate 42 so that the plate is forcibly displaced translationally within tube 64. This motion is transmitted to sabot 52 containing projectile 54 so that both move rapidly toward the exit end of the tube. When the sabot and plate reach the distal end of rod 56, the center hole through these two elements makes interference contact with protuberance 60 whereby the sabot is restrained or structurally broken and plate 42 is abruptly arrested from further movement and prevented from exiting tube 64. Projectile 54 is not so constrained, and continues its forward movement to the target. Launcher 10 is thereafter discarded and may be replaced by another pre-loaded launcher.

It should be understood that this invention could be used with other and different grenade shapes than ring airfoil grenades without departing from the scope of the inventive concept. Sabot 52 will naturally be configured to function cooperatively with any other grenade shape. Also, depending upon the materials of construction used for the sabot, it can be arrested in its forward movement at the muzzle end of tubular barrel 64 by conical wedge 60. This is preferably done after the sabot is beyond the muzzle of tube 64, as suggested by the relative location of the wedge and the muzzle end 68 of the tube shown in FIGS. 1 and 2. Where the sabot is relatively pliable or easily deformable, it may slip over the protuberance 60 and separates from grenade 54 by aerodynamic and centrifugal forces. However, in the preferred embodiment, sabot 52 has a sufficient rigidity to engage at least one slightly helical groove 70, or a plurality thereof, which function in the manner of the rifling in a gun barrel. Engagement of the sabot with groove 70 results in the groove imparting a twisting or rotational force to sabot 52 during its translational motion along barrel tube 64 so that the sabot, and projectile 54 nestled therewithin, leave the muzzle of tube 64 with a rapidly rotating motion.

I claim:

1. In a grenade launcher:

attachment means for removably attaching said launcher to a gun barrel, enclosed pressure chamber means for receiving propellant gas under pressure from the muzzle of said gun barrel when said launcher is actuated, elongate tubular means for guiding the initial movement path of a grenade upon the launching of said grenade, a breakable thrust-transmitting carrier contacting a force transmitting means for imparting thrust to a grenade, a grenade releasably nestled in said thrust-transmitting carrier, laterally translatable force transmitting means contained within said tubular means and communicating with said chamber means, for transmitting force from said propellant gas to said thrust-transmitting carrier, said thrust-transmitting carrier being adapted to accelerate continuously when said launcher is actuated and exit from said tubular means with said grenade nestled therewithin and thereafter to separate from said grenade so that said grenade continues its trajectory toward a target, and arresting means within said tubular means for arresting lateral translation of said force-transmitting means to prevent said force-transmitting means from exiting said tubular means when said grenade is launched.

2. The structure of claim 1 above, wherein:

said laterally translatable force transmitting means is a disc adapted to make close surface contact with said tubular means about the periphery of said disc during said lateral translation, said arresting means includes an elongate rod cantilever mounted at one end thereof to said enclosed pressure chamber means, said disc having a hole through the center thereof through which said rod passes, said rod has a protuberance at the distal end thereof opposite from said mounted end, and said protuberance is larger than said center hole in said disc.

3. The structure of claim 2 above, wherein:

said thrust-transmitting carrier comprises a sabot having a center hole therethrough, and said rod projects through said hole in said sabot prior to launching said grenade.

4. The structure of claim 3 above, wherein:

said protuberance is sufficiently larger than said hole in said sabot to cause said protruberance to break said sabot apart during actuation of said launcher.

5. The structure in claim 2 above, wherein:

said elongate tubular means comprises a cylindrical tube having a muzzle at one end thereof, and said rod and protuberance extend outwardly from said tube beyond said muzzle.

* * * * *